US011450183B1

(12) United States Patent
Williams

(10) Patent No.: US 11,450,183 B1
(45) Date of Patent: Sep. 20, 2022

(54) SPORTS HEADGEAR SIGNALING SYSTEM

(71) Applicant: Michael Williams, Fontana, CA (US)

(72) Inventor: Michael Williams, Fontana, CA (US)

( * ) Notice: Subject to any disclaimer, the term of this patent is extended or adjusted under 35 U.S.C. 154(b) by 0 days.

(21) Appl. No.: 17/357,681

(22) Filed: Jun. 24, 2021

(51) Int. Cl.
*G08B 5/36* (2006.01)
*G08B 29/18* (2006.01)

(52) U.S. Cl.
CPC ..... *G08B 5/36* (2013.01); *G08B 29/183* (2013.01)

(58) Field of Classification Search
CPC ..... G08B 5/36; G08B 29/183
See application file for complete search history.

(56) References Cited

U.S. PATENT DOCUMENTS 2,582,232 A * 1/1952 Cesaro ..... G01K 11/22 374/118
3,916,818 A * 11/1975 Barr ..... G10K 5/00 116/70
6,181,236 B1 * 1/2001 Schneider, Jr. ..... G08B 1/08 340/323 R
6,794,989 B2 * 9/2004 Naegely ..... G08B 1/08 340/4.12
9,502,018 B2 * 11/2016 Cronin ..... G07C 1/28
2006/0180073 A1 * 8/2006 Nakamoto ..... G10K 5/00 116/200
2015/0109129 A1 * 4/2015 Merril ..... G08B 21/0438 340/573.1
2016/0203663 A1 * 7/2016 Proctor ..... F21V 33/0008 345/8
2020/0215961 A1 * 7/2020 Alataas ..... A42B 3/0453
2021/0042080 A1 * 2/2021 Killian ..... G05B 19/042

* cited by examiner

*Primary Examiner* — John A Tweel, Jr.
(74) *Attorney, Agent, or Firm* — Galvin Patent Law LLC; Brian R. Galvin; Brian S. Boon

(57) ABSTRACT

A headgear-based sports signaling system which includes a controller capable of transmitting electronic signals to receivers mounted in or on sports headgear, and wherein the receivers control lights or other displays in or on the sports headgear to signal events that have occurred during game play. In some configurations, the controller is a whistle with airflow detection which transmits signals to the headgear when airflow is detected in the whistle.

7 Claims, 10 Drawing Sheets

SPORTS HEADGEAR SIGNALING SYSTEM

CROSS-REFERENCE TO RELATED APPLICATIONS

None.

BACKGROUND

Field of the Art

The disclosure relates to the field of sports equipment, and more particularly to the field of signaling systems for indication of events during game play.

Discussion of the State of the Art

Signaling is frequently used in sports activities for communication during game play. For example, audible signals such as whistles can be used by referees to start and stop game play, and visual signals such as hand signals may be used by coaches to indicate to players what actions should be taken during game play.

While these means of communication are useful, there are drawbacks to such means of communication in many circumstances. As several non-limiting examples, noisy crowds of cheering fans in a stadium may prevent players from hearing the referee's whistle, players with hearing loss or deafness may be unable to hear the sound of a whistle, and coded hand signals used by coaches in baseball may be decoded by opposing teams.

What is needed is a headgear-based sports signaling system that allows for reliable and discrete signaling in sports activities.

SUMMARY

Accordingly, the inventor has conceived and reduced to practice, a headgear-based sports signaling system. The system comprises a controller capable of transmitting electronic signals to receivers mounted in or on sports headgear, wherein the receivers control lights or other displays in or on the sports headgear. In some embodiments, the controller is a whistle with airflow detection which transmits signals to the headgear when airflow is detected in the whistle.

According to a preferred embodiment, a sports headgear signaling system is disclosed, comprising: a whistle controller with airflow detection comprising: a whistle; a first airflow sensor; a signal transmitter; and a first control unit further comprising a first processor, a first memory, and a first plurality of programming instructions stored in the first memory which, when operating on the first processor, causes the controller to: receive data from the airflow sensor; process the data from the airflow sensor to detect airflow through the whistle; transmit a signal using the signal transmitter; and a sports headgear comprising: a headgear unit wearable on the head of a human user; one or more lights; a signal receiver; and a second control unit further comprising a second processor, a second memory, and a second plurality of programming instructions stored in the second memory which, when operating on the second processor, causes the second controller to: receive the signal from the signal receiver; process the signal to determine which of the one or more lights to illuminate; and illuminate the lights corresponding to the determination.

According to an aspect of an embodiment, the whistle controller further comprises one or more buttons which, when pressed, cause the first control unit to change the signal transmitted using the signal transmitter, and wherein, upon receipt of the changed signal, the second control unit changes the illumination of some or all of lights based on the changed signal.

According to an aspect of an embodiment, the lights are light emitting diodes.

According to an aspect of an embodiment, some of the lights are of different colors than others.

According to an aspect of an embodiment, the first airflow sensor is a temperature sensor.

According to an aspect of an embodiment, the first airflow sensor is a pressure sensor.

According to an aspect of an embodiment, the first airflow sensor is a rotary sensor.

According to an aspect of an embodiment, the system further comprises a second airflow sensor of a different type from the first airflow sensor, and the first control unit is further configured to compare data from the first airflow sensor with data from the second airflow sensor to reduce false positive indications of airflow.

BRIEF DESCRIPTION OF THE DRAWING FIGURES

The accompanying drawings illustrate several aspects and, together with the description, serve to explain the principles of the invention according to the aspects. It will be appreciated by one skilled in the art that the particular arrangements illustrated in the drawings are merely exemplary, and are not to be considered as limiting of the scope of the invention or the claims herein in any way.

DETAILED DESCRIPTION

Figure 1:
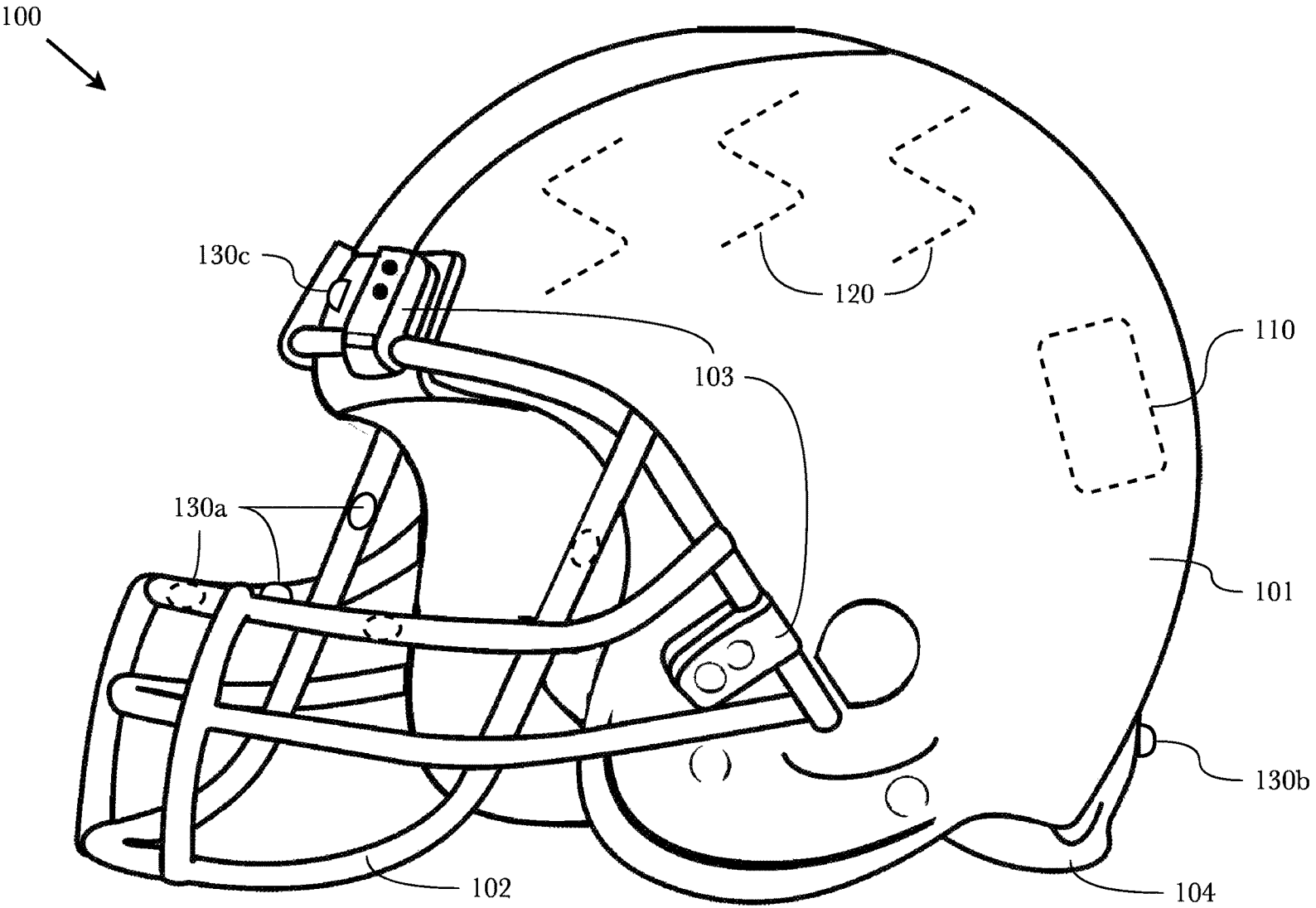
FIG. 1 is a diagram illustrating an exemplary configuration of the headgear portion of a sports headgear signaling system.

The inventor has conceived, and reduced to practice, a headgear-based sports signaling system. The system comprises a controller capable of transmitting electronic signals to receivers mounted in or on sports headgear, wherein the receivers control lights or other displays in or on the sports headgear. In some embodiments, the controller is a whistle with airflow detection which transmits signals to the headgear when airflow is detected in the whistle.

In many types of sports, particularly in team-based sports played on fields such as American football, game play is controlled by a referee who indicates critical events using a whistle. For example, game play is often started or stopped by the referee by blowing on a whistle. A disadvantage of using audible signals such as whistles is that they may be difficult or impossible to hear under certain circumstances. For example, it may be difficult for players to hear a whistle if the stadium is full of cheering fans, or players who are hard of hearing or deaf may be unable to hear a whistle.

In other types of sports, such as car racing, audible signals cannot be used either because of the noise generated by the activity, or the distance from the signaler to the sportsperson, or other factors. In such cases, visual signals may be necessary to indicate critical events during training and/or competition.

In some sports and situations, covert signaling to players may be desirable, such as in baseball where coaches and players rely on coded hand signals to indicate what actions to take during game play. While coded hand signals are useful, they can be decoded by opposing teams, and a non-visible messaging system may be desirable.

The headgear-based sports signaling system allows coaches and referees to signal to players discretely by using controllers to activate lights or other displays mounted to a piece of headgear such that only the player(s) wearing the headgear can see the lights. Many different configurations and implementations are possible, depending on the sport being played, the purpose of the signaling, or the circumstances surrounding the signaling. For example, the lights may be incandescent lights or, more likely, light emitting diodes (LEDs) mounted to the inside of a face guard or the edge of a helmet. The lights may be of single colors or multiple colors (e.g., red, yellow, green) indicating certain types of events (e.g., red may mean "stop play"). The lights may be flashed or pulsed to grab attention or to provide additional information (e.g., three flashes of a red light may mean that an injury has occurred on the field, or that a crash has occurred on a race track). Several non-limiting examples of specific configurations and implementations are listed below for clarity.

In American football, the referee starts and stops play by blowing on a whistle. Under ideal circumstances, all players hear the whistle and take appropriate action (either starting or stopping their activities). Under some circumstances, however, some players may not hear the whistle, either resulting in a late start or a failure to stop game play, either of which can have negative consequences such as missed scoring opportunities or safety issues such as late hits (tackles) which can cause injury. In one embodiment of the system, each helmet is fitted with LEDs mounted inside the face guard of the helmet, the LEDs being oriented toward the player's face so that only the player can see the LEDs. The LEDs may be inset into the material of the face guard or surrounded by a light shield, thus preventing light from the LED escaping to the sides such that it is visible to someone not wearing the helmet. In some embodiments, the referee will have a handheld controller with buttons that may be pushed to transmit signals to the helmets indicating that a whistle has been blown or that some other event has occurred. In some embodiments, the referee's controller will be a whistle with an airflow detector that automatically transmits signals to the helmets indicating that a whistle has been blown or that some other event has occurred whenever airflow is detected inside the whistle.

In car racing, crashes and other events that occur during the race are typically indicated by a flag waved on the side of the track at the starting line. For example, a green flag indicates a clear track, a yellow flag indicates caution (slow down; no passing), and a red flag indicates danger (stop racing and pull over). A major problem with this flag signaling system is that the flag can only be viewed by the drivers from certain locations on the track, meaning that a full lap may be completed by some drivers before the flag is seen. Having several colored LEDs mounted inside each driver's helmet at the edge of the driver's field of vision, controlled by a controller operated by the flag waver allows all drivers to be signaled immediately upon deployment of the flag, eliminating dangerous conditions caused by some drivers not seeing the flag when it is deployed.

In baseball, coded hand signals (e.g., touching the visor of a baseball cap with the forefinger of the left hand) are often used by coaches to indicate to players what actions to take during game play. For example, the coach may indicate to the pitcher what kind of pitch to throw, or indicate to runners on base whether to steal a base, etc. A major problem with these coded hand signals can be decoded by opposing teams. While the coded hand signals are often obfuscated by several false signals interspersed with the real signal, it is possible for the opposing team to determine which is the real signal and take action to counter the signaled instructions (e.g., if the signal is to steal a base, the pitcher may throw to a mid-fielder to tag the base-stealing player out). One or more LEDs mounted under the visor of a baseball cap and facing the player may be used to discretely signal instructions to the player without any possibility of interception of the code by the opposing team. The LEDs may be inset into the material of the visor or surrounded by a light shield, thus preventing light from the LED escaping to the sides such that it is visible to someone not wearing the baseball cap.

One or more different aspects may be described in the present application. Further, for one or more of the aspects described herein, numerous alternative arrangements may be described; it should be appreciated that these are presented for illustrative purposes only and are not limiting of the aspects contained herein or the claims presented herein in any way. One or more of the arrangements may be widely applicable to numerous aspects, as may be readily apparent from the disclosure. In general, arrangements are described in sufficient detail to enable those skilled in the art to practice one or more of the aspects, and it should be appreciated that other arrangements may be utilized and that structural, logical, software, electrical and other changes may be made without departing from the scope of the particular aspects. Particular features of one or more of the aspects described herein may be described with reference to one or more particular aspects or figures that form a part of the present disclosure, and in which are shown, by way of illustration, specific arrangements of one or more of the aspects. It should be appreciated, however, that such features are not limited to usage in the one or more particular aspects or figures with reference to which they are described. The present disclosure is neither a literal description of all arrangements of one or more of the aspects nor a listing of features of one or more of the aspects that must be present in all arrangements.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an aspect with several components in communication with each other does not imply that all such components are required. To the contrary, a variety of optional components may be described to illustrate a wide variety of possible aspects and in order to more fully illustrate one or more aspects. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the aspects, and does not imply that the illustrated process is preferred. Also, steps are generally described once per aspect, but this does not mean they must occur once, or that they may only occur once each time a process, method, or algorithm is carried out or executed. Some steps may be omitted in some aspects or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other aspects need not include the device itself.

Techniques and mechanisms described or referenced herein will sometimes be described in singular form for clarity. However, it should be appreciated that particular aspects may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various aspects in which, for example, functions may be executed out of order from that shown or discussed, including substantially concurrently or in reverse order, depending on the functionality involved, as would be understood by those having ordinary skill in the art.

Detailed Description of Exemplary Aspects

FIG. 1 is a diagram illustrating an exemplary configuration of the headgear portion of a sports headgear signaling system. In American football, the referee starts and stops play by blowing on a whistle. Under ideal circumstances, all players hear the whistle and take appropriate action (either starting or stopping their activities). Under some circumstances, however, some players may not hear the whistle, either resulting in a late start or a failure to stop game play, either of which can have negative consequences such as missed scoring opportunities or safety issues such as late hits (tackles) which can cause injury.

In this embodiment, the headgear 100 is a specially-adapted American football helmet comprising a shell 101, a face guard or (also known as a face mask) 102, clips 103 for attaching the face guard to the shell, and a neck brace 104. The face guard 102 is fitted with one or more LEDs 130*a* mounted inside the face guard of the helmet, the LEDs being oriented toward the player's face so that only the player can see the LEDs. The LEDs may be inset into the material of the face guard or surrounded by a light shield, thus preventing light from the LED escaping to the sides such that it is visible to someone not wearing the helmet. The headgear 100 is equipped with an internally-mounted control unit 110, battery (not shown) and one or more internally-mounted antennas 120 for receiving signals from a controller. The control unit 110, antennas 120, and LEDs 130*a* are connected via wiring (not shown) inside the shell 101 and face guard 102. When the control unit 110 receives a signal from a controller, the control unit illuminates one or more of the LEDs 130*a*, thus signaling to the player wearing the helmet that a game play event has occurred. In some embodiments, the headgear 100 may have additional LEDs outside of the helmet 130*b*, 130*c* which can provide signaling to other players. For example, exterior LEDs may be used by coaches during training to indicate which players are on what teams for practice purposes (e.g., all players with red external LEDs 130*b*, 130*c* are on Team A and all players with green LEDs 130*b*, 130*c* are on Team B).

Figure 2:
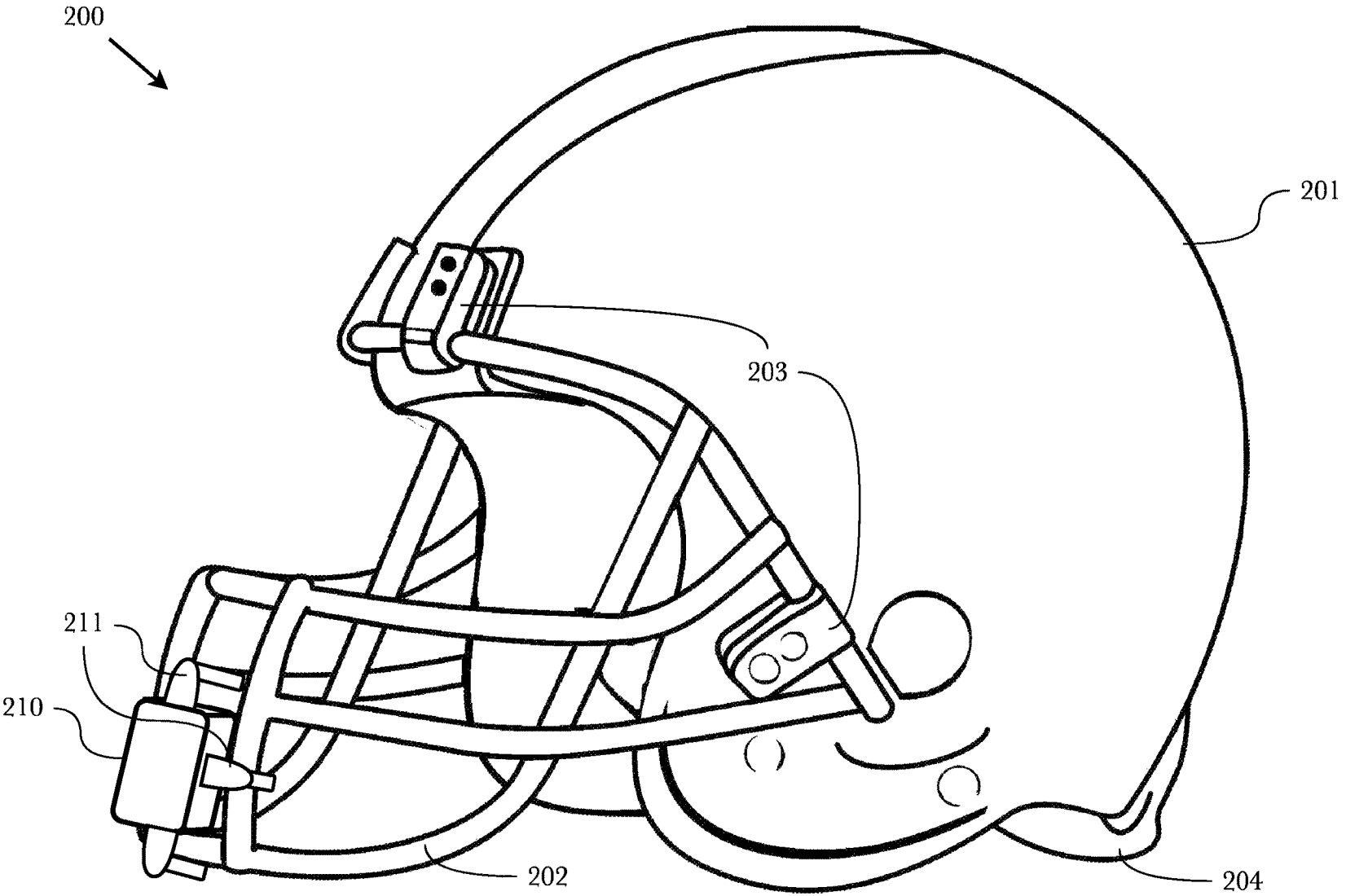
FIG. 2 is a diagram illustrating another exemplary configuration of the headgear portion of a sports headgear signaling system.

FIG. 2 is a diagram illustrating another exemplary configuration of the headgear portion of a sports headgear signaling system. In this embodiment, the headgear 200 is an American football helmet that has not been specially adapted for the signaling system, comprising a shell 201, a face guard or (also known as a face mask) 202, clips 203 for attaching the face guard to the shell, and a neck brace 204, and the signaling system is a self-contained unit 210 that attaches to the face guard 202 of the helmet with clips 211 or a similar fastener. In this embodiment, the self-contained unit 210 comprises an internal control unit, battery, and antenna, and on the side of the unit facing the player are several LEDs (not shown) which are operated by the self-contained unit 210 when signals are received by its internal control unit. This embodiment is convenient for conversion of non-adapted headgear for use with the signaling system.

Figure 3:
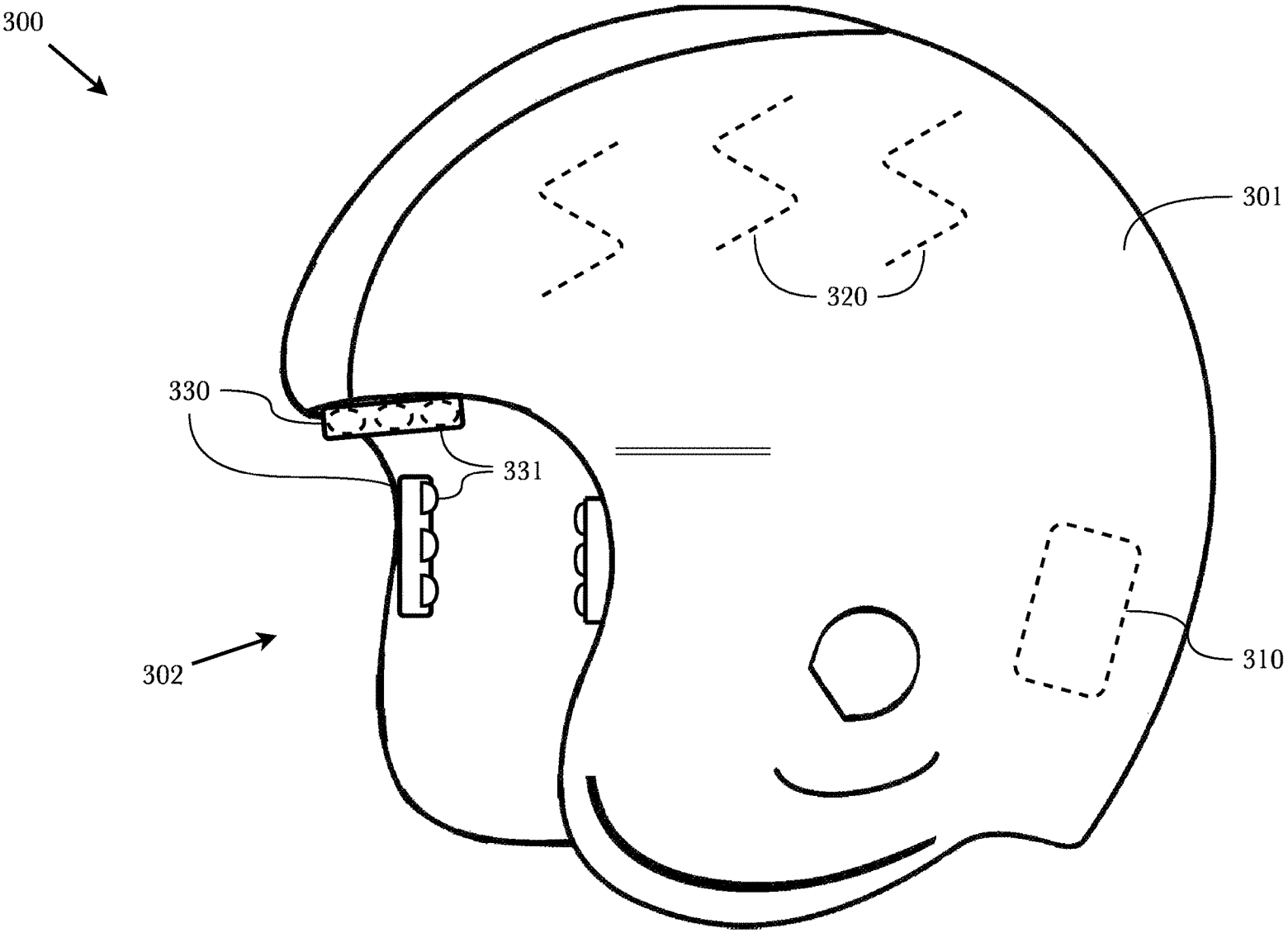
FIG. 3 is a diagram illustrating another exemplary configuration of the headgear portion of a sports headgear signaling system.

FIG. 3 is a diagram illustrating another exemplary configuration of the headgear portion of a sports headgear signaling system. In this embodiment, the headgear 300 is a specially-adapted car racing helmet comprising a shell 301. The shell 301 is fitted with one or more LED mounting brackets 330 arranged around the periphery of the open area 302 of the shell 301 around the user's face. One or more LEDs 331 are mounted on each mounting bracket 330, the LEDs being oriented toward the player's face so that only the player can see the LEDs. The LEDs may be inset into the material of the mounting brackets 330 or surrounded by light shields, thus preventing light from the LEDs from escaping to the sides such that it is visible to someone not wearing the helmet, although in this embodiment ensuring that light is not seen by persons not wearing the helmet is not a priority as the light is unlikely to be seen by other race car drivers. The headgear 300 is equipped with an internally-mounted control unit 310, battery (not shown), and one or more internally-mounted antennas 320 for receiving signals from a controller. The control unit 310, antennas 320, and LEDs 331 are connected via wiring (not shown) inside the shell 301. When the control unit 310 receives a signal from a controller, the control unit illuminates one or more of the LEDs 331, thus signaling to the driver wearing the helmet that a racing event has occurred.

In car racing, crashes and other events that occur during the race are typically indicated by a flag waved on the side of the track at the starting line. For example, a green flag indicates a clear track, a yellow flag indicates caution (slow down; no passing), and a red flag indicates danger (stop racing and pull over). A major problem with this flag signaling system is that the flag can only be viewed by the drivers from certain locations on the track, meaning that a full lap may be completed by some drivers before the flag is seen. Having several colored LEDs (e.g., green, yellow, and red) mounted inside each driver's helmet at the edge of the driver's field of vision, controlled by a controller operated by the flag waver allows all drivers to be signaled immediately upon deployment of the flag, eliminating dangerous conditions caused by some drivers not seeing the flag when it is deployed.

Figure 4:
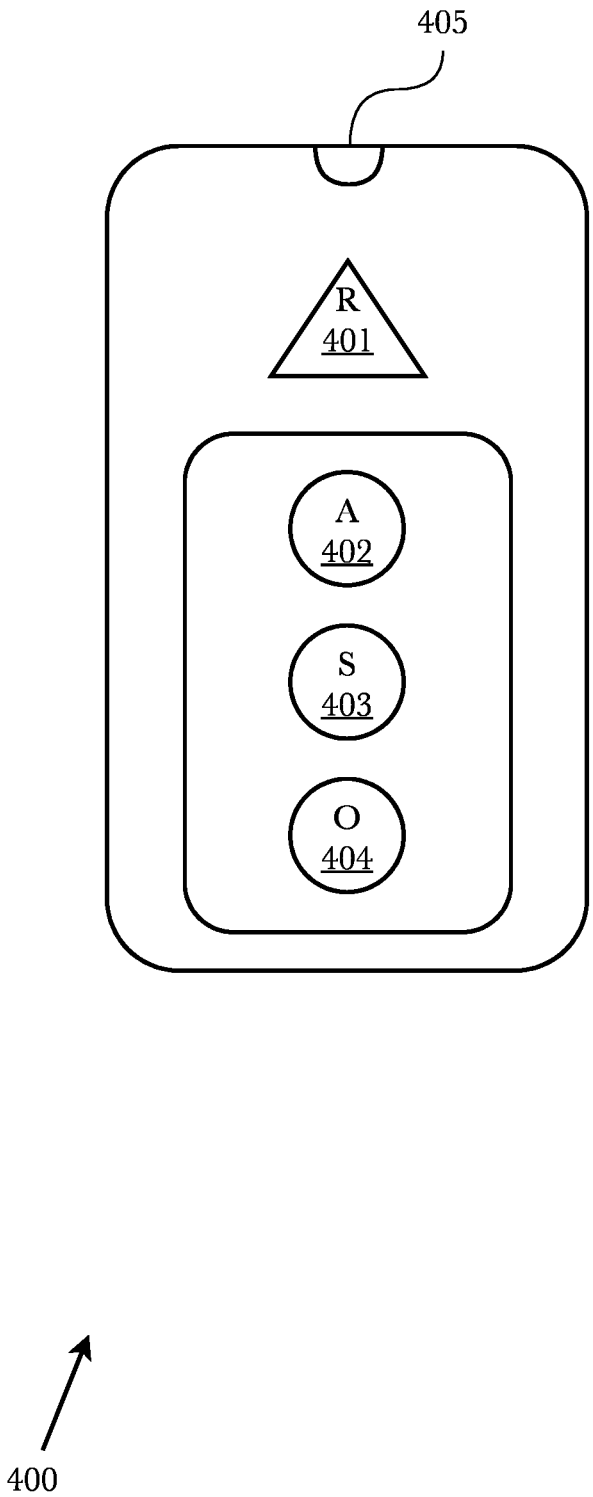
FIG. 4 is a diagram illustrating another exemplary handheld controller for a sports headgear signaling system.

FIG. 4 is a diagram illustrating another exemplary handheld controller for a sports headgear signaling system. In this embodiment, the handheld controller 400 has four buttons 401-404 that may be pushed to transmit signals to the helmets indicating that a whistle has been blown or that some other event has occurred. Button R 401 is a reset button that resets (e.g., turns off) the LEDs in all headgear within range of the controller. Button A 402 is an alert/whistle button that causes the sound emission port 405 to emit a whistle (or other) sound with no signaling to headgear. Button S 403 is s stop play button which signals helmet lights (e.g., activates a red LED in each receiving piece of headgear), and may optionally activate the sound emission port 405. Button O 404 is an option button, which may be programmed to perform various functions such as a flag, penalty, or warning. The handheld controller of this embodiment also has a speaker or sound emission port 405 which is programmed to emit sounds in response to certain button pushes. For example, when a stop play button is pushed, the speaker 405 may also emit a whistle noise which imitates the sound of a whistle blown on the play, thus eliminating the need for the referee to carry both the handheld controller and a whistle. In some embodiments, the handheld controller may be configured or programmed to send signals only to certain headgear within range, or each piece of headgear may be programmed to respond only to certain signals from the controller, such that pushing certain buttons will affect only some headgear within range of the controller.

Figure 5:
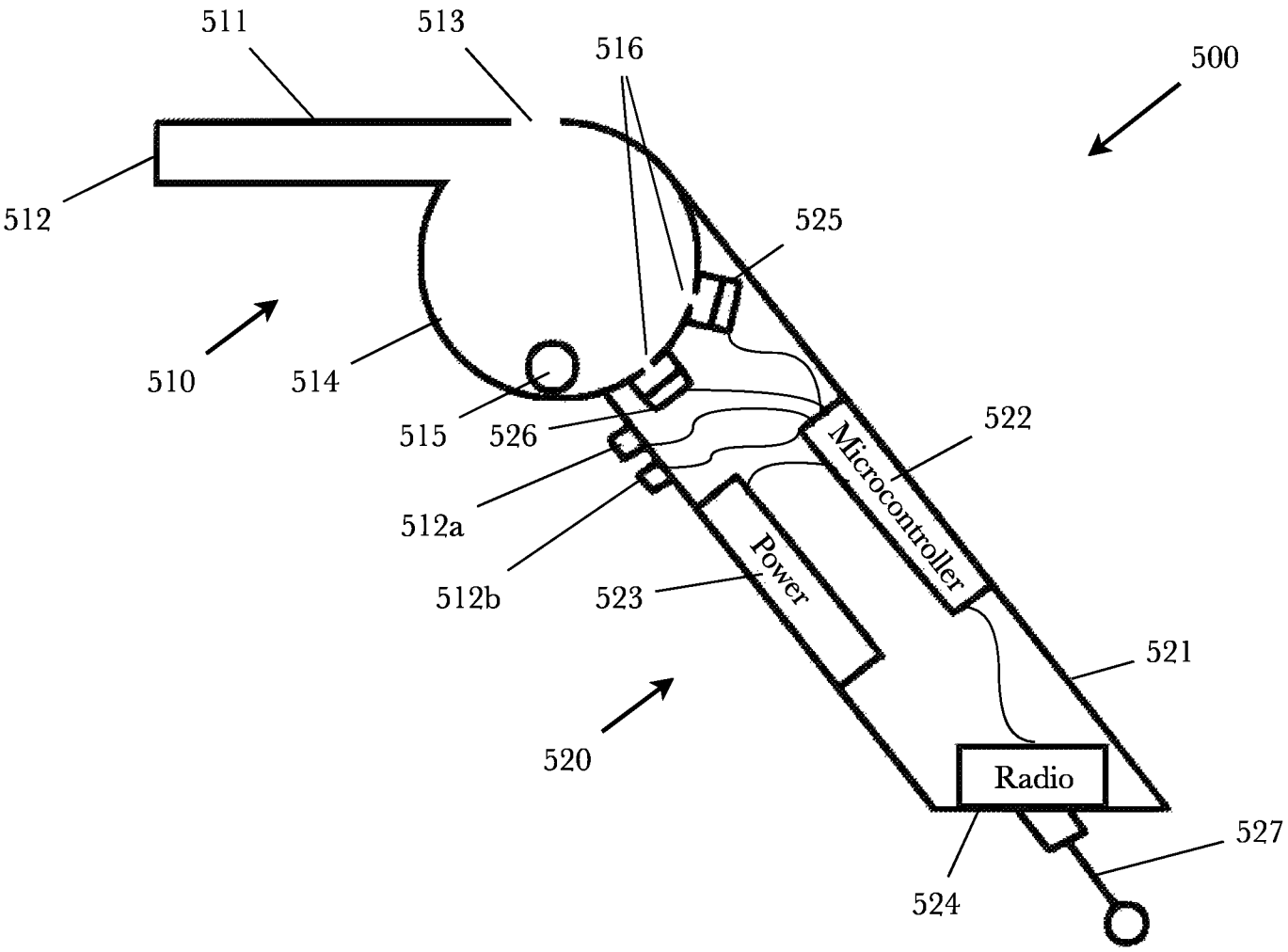
FIG. 5 is a diagram illustrating another exemplary whistle with airflow detection controller for a sports headgear signaling system.

FIG. 5 is a diagram illustrating another exemplary whistle with airflow detection controller for a sports headgear signaling system. In this embodiment, the controller 500 is a whistle with an airflow detector that automatically transmits signals to the helmets indicating that a whistle has been blown or that some other event has occurred whenever airflow is detected inside the whistle. The controller comprises a whistle portion 510 which allows for the production of an audible whistle tone, and a handle portion 520 containing the electronics for airflow detection and signal transmission. The whistle portion 510 comprises a mouthpiece 511 with an air inlet 512 into which air can be blown by a user's mouth, an air outlet 513 which causes an audible sound to be created by oscillation of air across the back edge of the air outlet 513, a body around which a portion of the air circulates, a ball 515 which periodically interrupts the air flow across the air outlet 513 causing a pulsing whistle sound, and two internal ports 516, one leading to a temperature sensor 525 and another one leading to a pressure sensor 526. The handle portion 520 comprises a housing 521, a microcontroller 522, a power source 523 (in this case a battery), a signal transmitter (e.g., radio transmitter) 524, a temperature sensor 525, a pressure sensor 526, and an antenna 527.

When air is blown into the air inlet 512, an audible whistle tone is generated from oscillation of air at the air outlet 513, a portion of the oscillating air spins around the whistle body 514, causing the ball 515 to spin roll around the inside of the body 514 in the direction of air flow. The rolling ball intermittently passes over the air outlet 513, momentarily and partially interrupting air flow and causing a pulsation of the audible whistle tone.

The temperature sensor 525 and pressure sensor 526 are used to detect air flow within the whistle portion 510. The temperature sensor 525 senses a change in temperature inside the whistle body 514 from the breath of the person blowing the whistle, and the pressure sensor 526 senses a change in pressure inside the whistle body from the breath of the person blowing the whistle.

The temperature sensor 525 and pressure sensor 526 may be used in several different configurations to detect airflow. The temperature 525 sensor may be used independently to detect a sudden change in temperature from the user's breath. Typically, the ambient air temperature will not be the same as body temperature, so a sudden change in temperature from the ambient temperature would indicate airflow. Depending on its configuration, the microcontroller 522 can be programmed to calculate a rate of change of the temperature sensor 525 to eliminate false positives (e.g., if the user moves from outside to indoors, resulting in a gradual ambient temperature change). Likewise, the pressure sensor 526 may be used independently to detect a sudden change in pressure from the user's breath. When a whistle is blown the internal pressure inside the whistle suddenly increases as a result of the force of the user's breath, so a sudden change in pressure from the ambient pressure would also indicate airflow. Depending on its configuration, the microcontroller 522 can be programmed to calculate a rate of change of the pressure to eliminate false positives (e.g., if the user descends stairs, resulting in a small elevation change and increase in pressure), and may be programmed to detect the vibrational frequency of the whistle (i.e., very rapid changes in pressure due to oscillation of air at the hole), thus further eliminating false positives. In some configurations, the temperature sensor 525 and pressure sensor 526 may be used in combination to detect airflow with each sensor acting as a check of, of confirmation of, the data from the other sensor (e.g., if the temperature suddenly increases because the whistle moves from shade to sun, but no change in pressure is indicated, the microcontroller 522 may be programmed to ignore the temperature input).

Note that other types of airflow sensors may be used, a non-limiting list of which includes rotary sensors such as propellers, fans, or blower cages which rotate in the presence of airflow causing a change in voltage or current or a change in a rotary detection device like a resolver or rotary encoder; microphones which detect either the audible whistle noise, a frequency associated with the audible whistle noise, or a pulsation caused by the ball rolling inside the whistle body; and optical sensors which detect changes in light across the sensor as the ball inside the whistle periodically rolls across the optical sensor.

The handle portion 520 further comprises button 512*a, b* inputs which may change the operation of the controller 500. For example, if the sensors 525, 526 indicate airflow is present, and no button is pushed, the signal transmitter 524 may send a signal to one or more helmets indicating that a red LED is to be activated. If the sensors 525, 526 indicate airflow is present, and button 1 512*a* is pushed, the signal transmitter 524 may send a signal to one or more helmets indicating that a yellow LED is to be activated. If the sensors 525, 526 indicate airflow is present, and button 2 512*b* is pushed, the signal transmitter 524 may send a signal to one or more helmets indicating that a green LED is to be activated.

Figure 6:
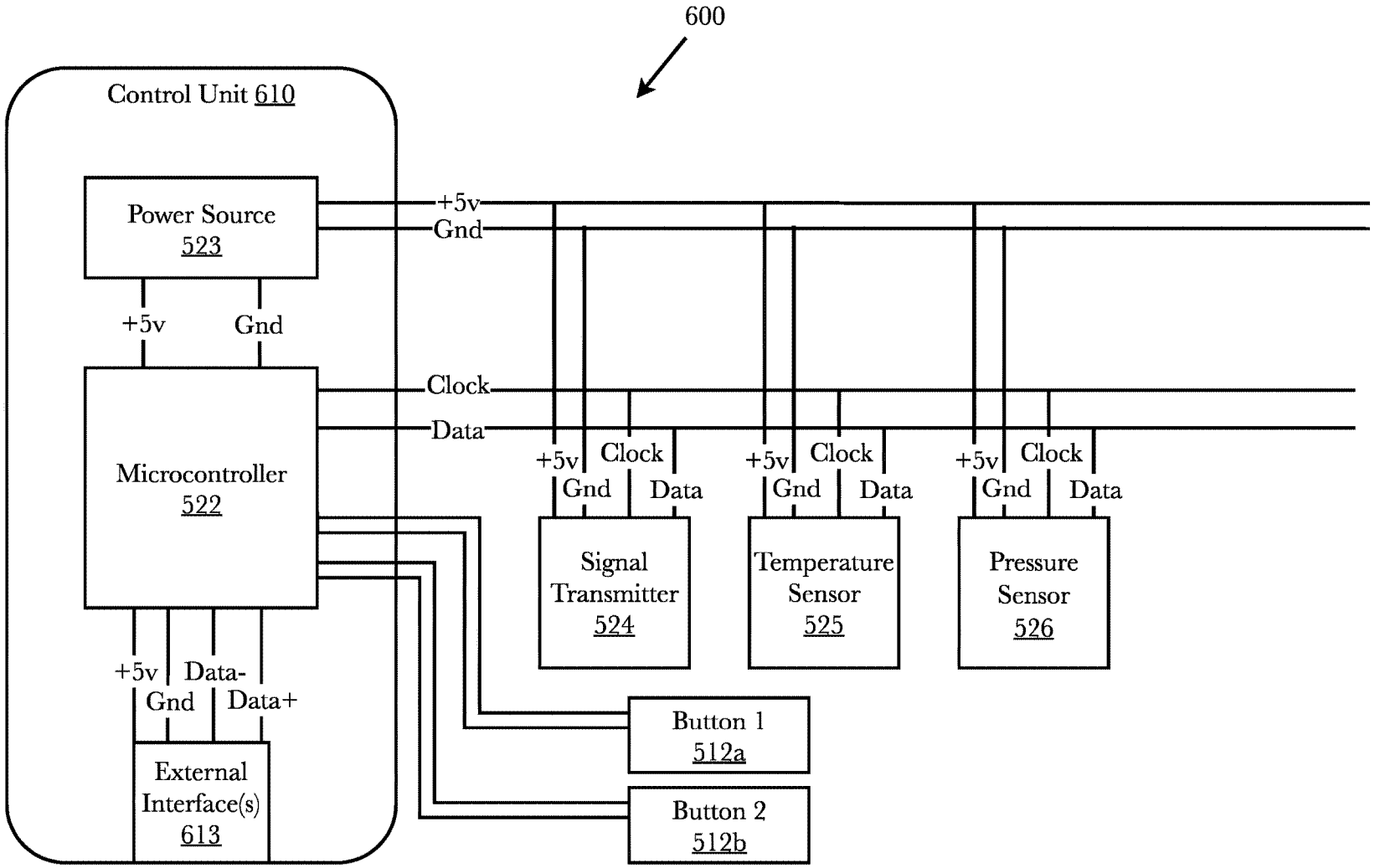
FIG. 6 is an exemplary system architecture diagram for the electronic components of the previously-described exemplary whistle with airflow detection controller.

FIG. 6 is an exemplary system architecture diagram for the electronic components of a control unit for the headgear portion and controller portion of a sports headgear signaling system. While system architecture 600 is described in terms of the whistle controller with airflow detection of FIG. 5, the same architecture applies to the control unit for the headgear portion of a sports headgear signaling system.

A control unit 610 comprises a power source 523, a microcontroller 522, and an external interface 613. The control unit 610 receives data from a temperature sensor 525 and a pressure sensor 526 and, depending on the data from those sensors, transmits a signal via a signal transmitter 524 to one or more compatible helmets. In some embodiments, the signal transmitter 524 may be a transceiver which also receives signals from the one or more helmets (e.g., confirmation of signal receipt to ensure that the correct LEDs on all helmets have been properly activated).

The temperature sensor 525 and pressure sensor 526 may be used in several different configurations to detect airflow. The temperature 525 sensor may be used independently to detect a sudden change in temperature from the user's breath. Typically, the ambient air temperature will not be the same as body temperature, so a sudden change in temperature from the ambient temperature would indicate airflow. Depending on its configuration, the microcontroller 522 can be programmed to calculate a rate of change of the temperature sensor 525 to eliminate false positives (e.g., if the user moves from outside to indoors, resulting in a gradual ambient temperature change). Likewise, the pressure sensor 526 may be used independently to detect a sudden change in pressure from the user's breath. When a whistle is blown the internal pressure inside the whistle suddenly increases as a result of the force of the user's breath, so a sudden change in pressure from the ambient pressure would also indicate airflow. Depending on its configuration, the microcontroller 522 can be programmed to calculate a rate of change of the pressure to eliminate false positives (e.g., if the user descends stairs, resulting in a small elevation change and increase in pressure), and may be programmed to detect the vibrational frequency of the whistle (i.e., very rapid changes in pressure due to oscillation of air at the hole), thus further eliminating false positives. In some configurations, the temperature sensor 525 and pressure sensor 526 may be used in combination to detect airflow with each sensor acting as a check of, of confirmation of, the data from the other sensor (e.g., if the temperature suddenly increases because the whistle moves from shade to sun, but no change in pressure is indicated, the microcontroller 522 may be programmed to ignore the temperature input).

The control unit 610 further controls the operation of a signal transmitter 524, depending on the sensor 525, 526 and button 512*a, b* inputs. For example, if the sensors 525, 526 indicate airflow is present, and no button is pushed, the signal transmitter 524 may send a signal to one or more helmets indicating that a red LED is to be activated. If the sensors 525, 526 indicate airflow is present, and button 1 512*a* is pushed, the signal transmitter 524 may send a signal to one or more helmets indicating that a yellow LED is to be activated. If the sensors 525, 526 indicate airflow is present, and button 2 512*b* is pushed, the signal transmitter 524 may send a signal to one or more helmets indicating that a green LED is to be activated.

In this embodiment, the power source 523 is internal batteries, but in other embodiments the power source 523 may be supplied from other sources. For example, power could be supplied to the control unit by an external battery through the external interface 613. The external interface 613 is an interface capable of communicating with another electronic device, and may be wired or wireless. In this embodiment, a standard universal serial bus, Type A (USB-A) interface is shown with four wires corresponding to +5 volts, ground, data−, and data+, but other configurations are possible, including a wireless radio configured to connect to other wireless devices through wireless protocols such as Bluetooth and WiFi. A person of ordinary skill in the art will recognize that this configuration is simply one of many such configurations, and that the various components may be contained in, or distributed among, various other components and/or locations.

The microcontroller 522 is a small computing device with one or more processors, a memory, communications controllers, and one or more inputs and outputs. Microcontrollers in this type of application are typically pre-programmed for the intended use. The microcontroller 522 is used to receive input signals either from sensors or other computing devices, and perform certain actions based on the signals received. In this embodiment, the microcontroller 522 contains an inter-integrated circuit bus (also known as I2C) which allows for fully-addressable serial communication with slave devices such as the signal transmitter 524, using common wires for +5v and ground (for power), a clock signal, and data. While not required in this embodiment, the temperature sensor 525 and pressure sensor 526 may also contain a communications controller allowing for I2C serial communications with the microcontroller 522. The buttons 512*a, b* are typically configured an binary switches (on/off) that are routed to designated ports on the microcontroller 522 that can detect low or high voltage across the buttons.

Although this example uses the I2C serial communications protocol, any addressable communication protocol may be used, including serial and parallel communications protocols, such as serial to peripheral interface (SPI), universal asynchronous receiver-transmitter (UART), etc. In some embodiments, direct pinouts from the microcontroller may be used instead of addressable communications protocols. In some embodiments, wireless communications between the microcontroller 522, the signal transmitter 524, the temperature sensor 525, and the pressure sensor 526, and the buttons 512*a, b* may be used instead of wired communications.

Note that in some embodiments, an intermediate device may be used, wherein the signal transmitter transmits a signal to the intermediate device, and the intermediate device transmits the signal to one or more of the pieces of sports headgear. For example, where long distance transmission of the signal is required, the handheld controller or whistle controller may lack sufficient power to transmit the required distance. In such a case, a signal booster may be used as an intermediary device, receiving the signal from the controller, amplifying the signal power, and transmitting the amplified signal. The intermediary device may be located in any convenient location. In some embodiments, the intermediate device will be plugged in to mains power (e.g., 120V/240V). In other embodiments, the intermediate device will be a battery powered device worn on the belt of, or in a small backpack of, the referee.

Hardware Architecture

Generally, the techniques disclosed herein may be implemented on hardware or a combination of software and hardware. For example, they may be implemented in an operating system kernel, in a separate user process, in a library package bound into network applications, on a specially constructed machine, on an application-specific integrated circuit (ASIC), or on a network interface card.

Software/hardware hybrid implementations of at least some of the aspects disclosed herein may be implemented on a programmable network-resident machine (which should be understood to include intermittently connected network-aware machines) selectively activated or reconfigured by a computer program stored in memory. Such network devices may have multiple network interfaces that may be configured or designed to utilize different types of network communication protocols. A general architecture for some of these machines may be described herein in order to illustrate one or more exemplary means by which a given unit of functionality may be implemented. According to specific aspects, at least some of the features or functionalities of the various aspects disclosed herein may be implemented on one or more general-purpose computers associated with one or more networks, such as for example an end-user computer system, a client computer, a network server or other server system, a mobile computing device (e.g., tablet computing device, mobile phone, smartphone, laptop, or other appropriate computing device), a consumer electronic device, a music player, or any other suitable electronic device, router, switch, or other suitable device, or any combination thereof. In at least some aspects, at least some of the features or functionalities of the various aspects disclosed herein may be implemented in one or more virtualized computing environments (e.g., network computing clouds, virtual machines hosted on one or more physical computing machines, or other appropriate virtual environments).

Figure 7:
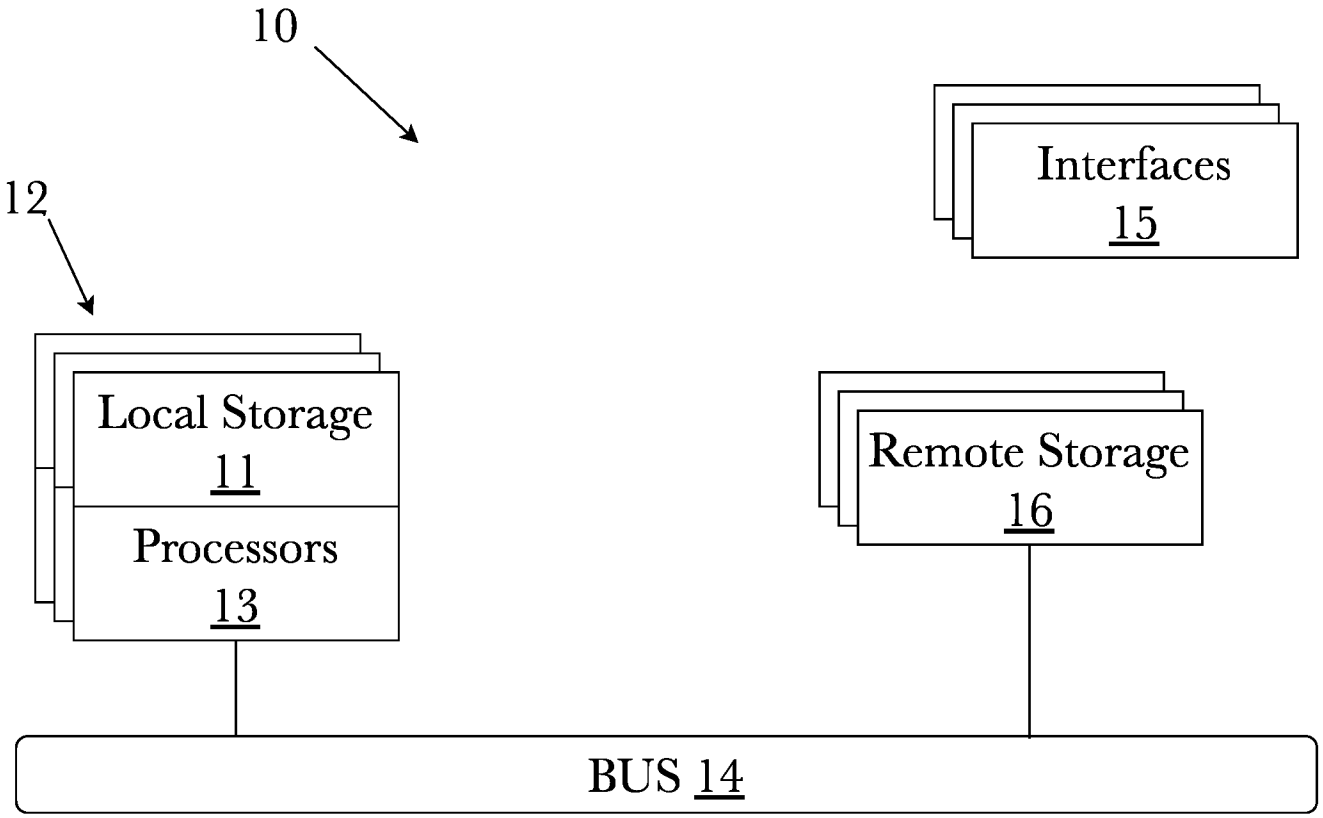
FIG. 7 is a block diagram illustrating an exemplary hardware architecture of a computing device.

Referring now to FIG. 7, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one aspect, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one aspect, a computing device 10 may be configured or designed to function as a server system utilizing CPU 12, local memory 11 and/or remote memory 16, and interface(s) 15. In at least one aspect, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some aspects, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a particular aspect, a local memory 11 (such as non-volatile random access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one aspect, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (WiFi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity AN hardware interfaces) and, in some instances, volatile and/or non-volatile memory (e.g., RAM).

Although the system shown in FIG. 7 illustrates one specific architecture for a computing device 10 for implementing one or more of the aspects described herein, it is by no means the only device architecture on which at least a portion of the features and techniques described herein may be implemented. For example, architectures having one or any number of processors 13 may be used, and such processors 13 may be present in a single device or distributed among any number of devices. In one aspect, a single processor 13 handles communications as well as routing computations, while in other aspects a separate dedicated communications processor may be provided. In various aspects, different types of features or functionalities may be implemented in a system according to the aspect that includes a client device (such as a tablet device or smartphone running client software) and server systems (such as a server system described in more detail below).

Regardless of network device configuration, the system of an aspect may employ one or more memories or memory modules (such as, for example, remote memory block 16 and local memory 11) configured to store data, program instructions for the general-purpose network operations, or other information relating to the functionality of the aspects described herein (or any combinations of the above). Program instructions may control execution of or comprise an operating system and/or one or more applications, for example. Memory 16 or memories 11, 16 may also be configured to store data structures, configuration data, encryption data, historical system operations information, or any other specific or generic non-program information described herein.

Because such information and program instructions may be employed to implement one or more systems or methods described herein, at least some network device aspects may include nontransitory machine-readable storage media, which, for example, may be configured or designed to store program instructions, state information, and the like for performing various operations described herein. Examples of such nontransitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

Figure 8:
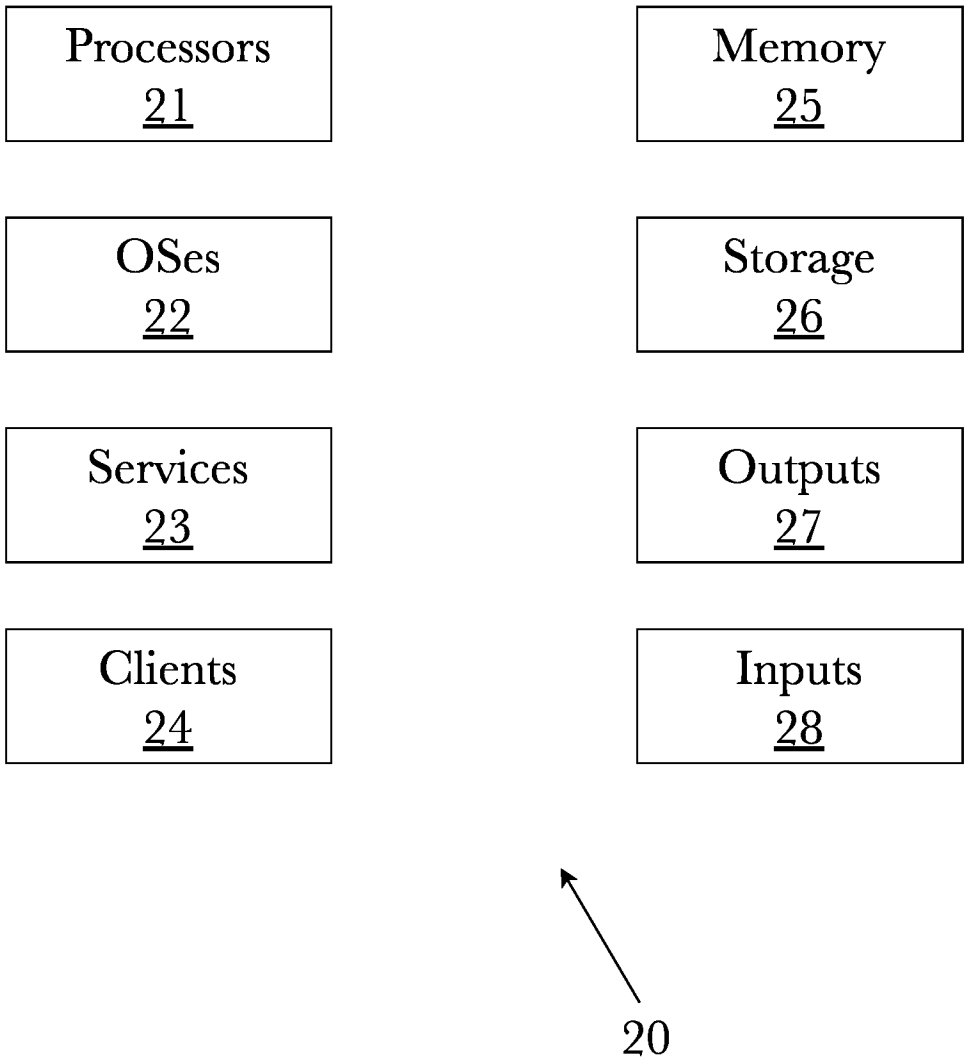
FIG. 8 is a block diagram illustrating an exemplary logical architecture for a client device.

In some aspects, systems may be implemented on a standalone computing system. Referring now to FIG. 8, there is shown a block diagram depicting a typical exemplary architecture of one or more aspects or components thereof on a standalone computing system. Computing device 20 includes processors 21 that may run software that carry out one or more functions or applications of aspects, such as for example a client application 24. Processors 21 may carry out computing instructions under control of an operating system 22 such as, for example, a version of MICROSOFT WINDOWS™ operating system, APPLE macOS™ or iOS™ operating systems, some variety of the Linux operating system, ANDROID™ operating system, or the like. In many cases, one or more shared services 23 may be operable in system 20, and may be useful for providing common services to client applications 24. Services 23 may for example be WINDOWS™ services, user-space common services in a Linux environment, or any other type of common service architecture used with operating system 21. Input devices 28 may be of any type suitable for receiving user input, including for example a keyboard, touchscreen, microphone (for example, for voice input), mouse, touchpad, trackball, or any combination thereof. Output devices 27 may be of any type suitable for providing output to one or more users, whether remote or local to system 20, and may include for example one or more screens for visual output, speakers, printers, or any combination thereof. Memory 25 may be random-access memory having any structure and architecture known in the art, for use by processors 21, for example to run software. Storage devices 26 may be any magnetic, optical, mechanical, memristor, or electrical storage device for storage of data in digital form (such as those described above, referring to FIG. 7). Examples of storage devices 26 include flash memory, magnetic hard drive, CD-ROM, and/or the like.

Figure 9:
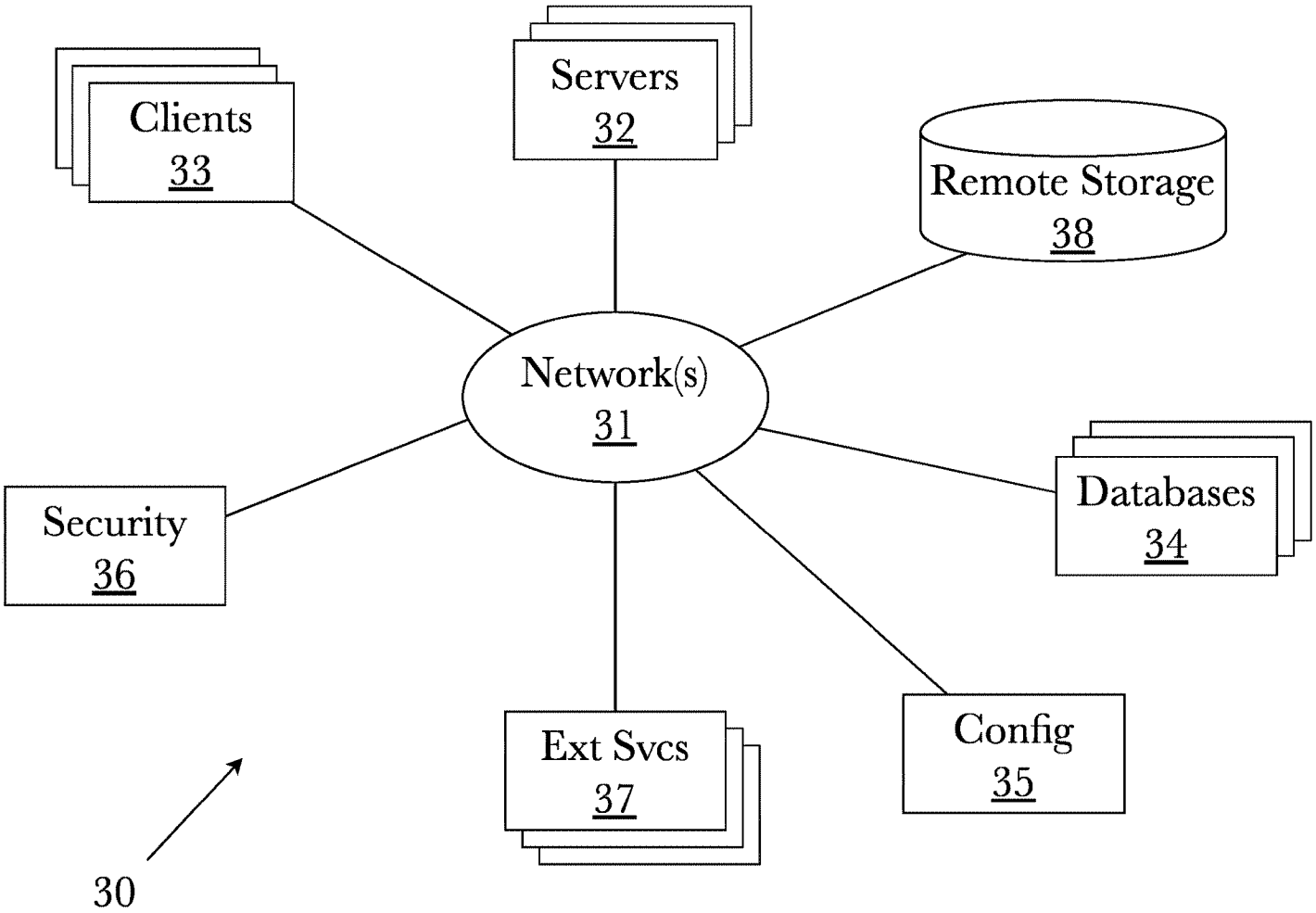
FIG. 9 is a block diagram showing an exemplary architectural arrangement of clients, servers, and external services.

In some aspects, systems may be implemented on a distributed computing network, such as one having any number of clients and/or servers. Referring now to FIG. 9, there is shown a block diagram depicting an exemplary architecture 30 for implementing at least a portion of a system according to one aspect on a distributed computing network. According to the aspect, any number of clients 33 may be provided. Each client 33 may run software for implementing client-side portions of a system; clients may comprise a system 20 such as that illustrated in FIG. 8. In addition, any number of servers 32 may be provided for handling requests received from one or more clients 33. Clients 33 and servers 32 may communicate with one another via one or more electronic networks 31, which may be in various aspects any of the Internet, a wide area network, a mobile telephony network (such as CDMA or GSM cellular networks), a wireless network (such as WiFi, WiMAX, LTE, and so forth), or a local area network (or indeed any network topology known in the art; the aspect does not prefer any one network topology over any other). Networks 31 may be implemented using any known network protocols, including for example wired and/or wireless protocols.

In addition, in some aspects, servers 32 may call external services 37 when needed to obtain additional information, or to refer to additional data concerning a particular call. Communications with external services 37 may take place, for example, via one or more networks 31. In various aspects, external services 37 may comprise web-enabled services or functionality related to or installed on the hardware device itself. For example, in one aspect where client applications 24 are implemented on a smartphone or other electronic device, client applications 24 may obtain information stored in a server system 32 in the cloud or on an external service 37 deployed on one or more of a particular enterprise's or user's premises. In addition to local storage on servers 32, remote storage 38 may be accessible through the network(s) 31.

In some aspects, clients 33 or servers 32 (or both) may make use of one or more specialized services or appliances that may be deployed locally or remotely across one or more networks 31. For example, one or more databases 34 in either local or remote storage 38 may be used or referred to by one or more aspects. It should be understood by one having ordinary skill in the art that databases in storage 34 may be arranged in a wide variety of architectures and using a wide variety of data access and manipulation means. For example, in various aspects one or more databases in storage 34 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In some aspects, variant database architectures such as column-oriented databases, in-memory databases, clustered databases, distributed databases, or even flat file data repositories may be used according to the aspect. It will be appreciated by one having ordinary skill in the art that any combination of known or future database technologies may be used as appropriate, unless a specific database technology or a specific arrangement of components is specified for a particular aspect described herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, some aspects may make use of one or more security systems 36 and configuration systems 35. Security and configuration management are common information technology (IT) and web functions, and some amount of each are generally associated with any IT or web systems. It should be understood by one having ordinary skill in the art that any configuration or security subsystems known in the art now or in the future may be used in conjunction with aspects without limitation, unless a specific security 36 or configuration system 35 or approach is specifically required by the description of any specific aspect.

Figure 10:
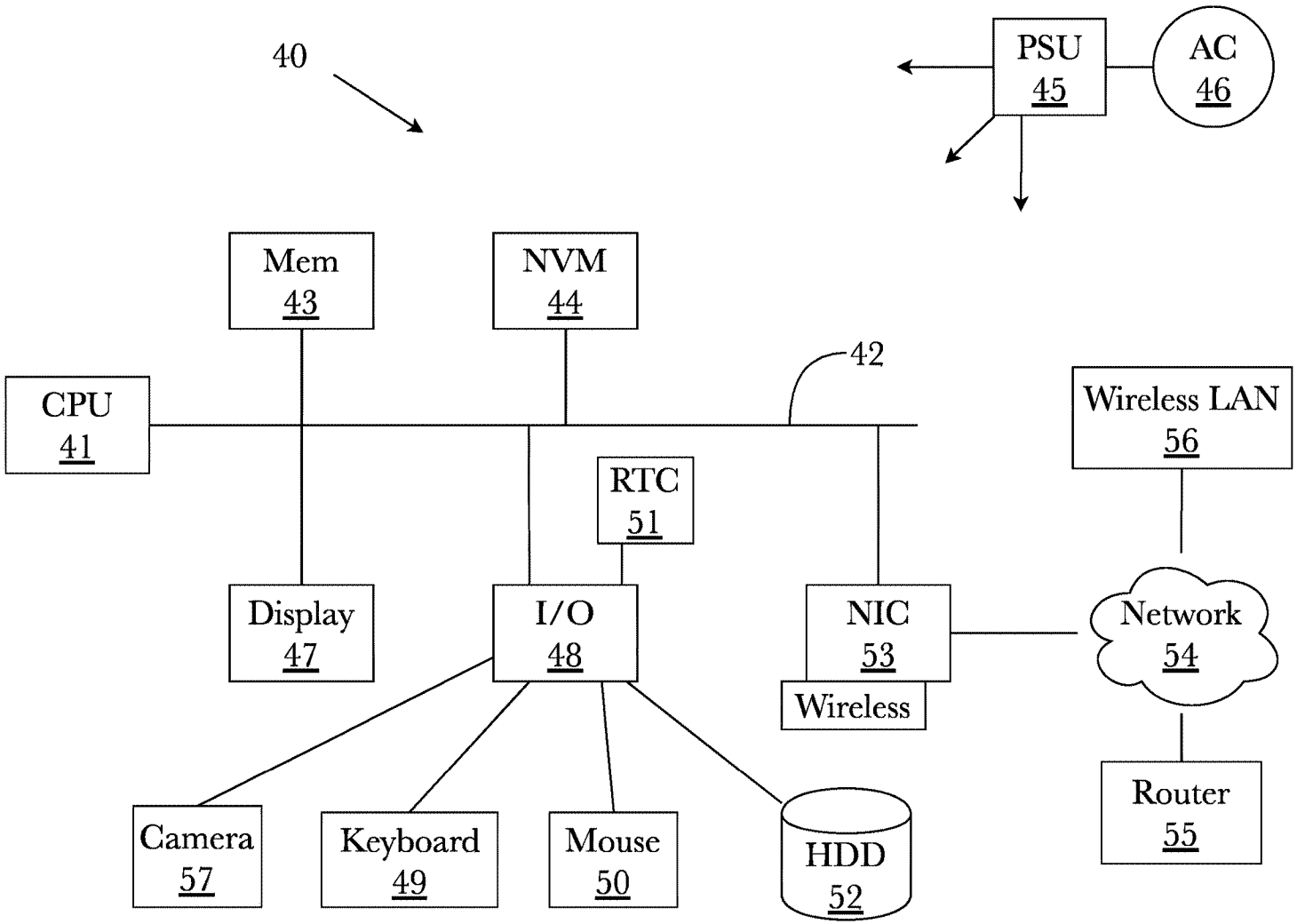
FIG. 10 is another block diagram illustrating an exemplary hardware architecture of a computing device.

FIG. 10 shows an exemplary overview of a computer system 40 as may be used in any of the various locations throughout the system. It is exemplary of any computer that may execute code to process data. Various modifications and changes may be made to computer system 40 without departing from the broader scope of the system and method disclosed herein. Central processor unit (CPU) 41 is connected to bus 42, to which bus is also connected memory 43, nonvolatile memory 44, display 47, input/output (I/O) unit 48, and network interface card (NIC) 53. I/O unit 48 may, typically, be connected to peripherals such as a keyboard 49, pointing device 50, hard disk 52, real-time clock 51, a camera 57, and other peripheral devices. NIC 53 connects to network 54, which may be the Internet or a local network, which local network may or may not have connections to the Internet. The system may be connected to other computing devices through the network via a router 55, wireless local area network 56, or any other network connection. Also shown as part of system 40 is power supply unit 45 connected, in this example, to a main alternating current (AC) supply 46. Not shown are batteries that could be present, and many other devices and modifications that are well known but are not applicable to the specific novel functions of the current system and method disclosed herein. It should be appreciated that some or all components illustrated may be combined, such as in various integrated applications, for example Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices).

In various aspects, functionality for implementing systems or methods of various aspects may be distributed among any number of client and/or server components. For example, various software modules may be implemented for performing various functions in connection with the system of any particular aspect, and such modules may be variously implemented to run on server and/or client components.

The skilled person will be aware of a range of possible modifications of the various aspects described above. Accordingly, the present invention is defined by the claims and their equivalents.

What is claimed is:

1. A sports headgear signaling system, comprising:

a whistle controller with airflow detection comprising:

a whistle;

a first airflow sensor;

a second airflow sensor of a different type from the first airflow sensor;

a signal transmitter; and a first control unit further comprising a first processor, a first memory, and a first plurality of programming instructions stored in the first memory which, when operating on the first processor, causes the controller to:

receive data from the first airflow sensor and the second airflow sensor;

process the data from the airflow sensors to detect airflow through the whistle;

compare the data from the first airflow sensor with the data from the second airflow sensor to reduce false positive indications of airflow;

transmit a signal using the signal transmitter; and a sports headgear comprising:

a headgear unit wearable on the head of a human user;

one or more lights;

a signal receiver; and a second control unit further comprising a second processor, a second memory, and a second plurality of programming instructions stored in the second memory which, when operating on the second processor, causes the second control unit to:

receive the signal from the signal receiver;

process the signal to determine which of the one or more lights to illuminate; and illuminate the lights corresponding to the determination.

2. The system of claim 1, wherein the whistle controller further comprises one or more buttons which, when pressed, cause the first control unit to change the signal transmitted using the signal transmitter, and wherein, upon receipt of the changed signal, the second control unit changes the illumination of some or all of lights based on the changed signal.

3. The system of claim 1, wherein the lights are light emitting diodes.

4. The system of claim 1, wherein some of the lights are of different colors than others.

5. The system of claim 1, wherein the first airflow sensor is a temperature sensor.

6. The system of claim 1, wherein the first airflow sensor is a pressure sensor.

7. The system of claim 1, wherein the first airflow sensor is a rotary sensor.

* * * * *